US012281402B2

(12) United States Patent
Wilmot et al.

(10) Patent No.: US 12,281,402 B2
(45) Date of Patent: Apr. 22, 2025

(54) LOW ANGLE MEMBRANE FRAME FOR AN ELECTROPLATING CELL

(71) Applicant: LAM RESEARCH CORPORATION, Fremont, CA (US)

(72) Inventors: Frederick Dean Wilmot, Gladstone, OR (US); Robert Rash, West Linn, OR (US); Nirmal Shankar Sigamani, Sherwood, OR (US); Gabriel Graham, Portland, OR (US)

(73) Assignee: Lam Research Corporation, Fremont, CA (US)

( * ) Notice: Subject to any disclaimer, the term of this patent is extended or adjusted under 35 U.S.C. 154(b) by 541 days.

(21) Appl. No.: 17/639,514

(22) PCT Filed: Sep. 2, 2020

(86) PCT No.: PCT/US2020/048972
§ 371 (c)(1),
(2) Date: Mar. 1, 2022

(87) PCT Pub. No.: WO2021/046068
PCT Pub. Date: Mar. 11, 2021

(65) Prior Publication Data

US 2022/0298667 A1 Sep. 22, 2022

Related U.S. Application Data

(60) Provisional application No. 62/895,245, filed on Sep. 3, 2019.

(51) Int. Cl.

| | |
|---|---|
| ***C25D 17/00*** | (2006.01) |
| ***C25D 17/08*** | (2006.01) |
| ***C25D 17/10*** | (2006.01) |

(52) U.S. Cl.
CPC ..... *C25D 17/002* (2013.01); *C25D 17/001* (2013.01); *C25D 17/008* (2013.01); *C25D 17/08* (2013.01); *C25D 17/10* (2013.01)

(58) Field of Classification Search
None
See application file for complete search history.

(56) References Cited

U.S. PATENT DOCUMENTS

| | | | |
|---|---|---|---|
| 6,964,792 | B1 | 11/2005 | Mayer et al. |
| 7,374,645 | B2 | 5/2008 | Davis et al. |

(Continued)

FOREIGN PATENT DOCUMENTS

| | | | |
|---|---|---|---|
| CN | 105821457 | A | 8/2016 |
| CN | 106480481 | A | 3/2017 |

(Continued)

OTHER PUBLICATIONS

Office Action issued in corresponding Chinese Patent Application 202080062180.X dated Dec. 5, 2023.

(Continued)

*Primary Examiner* — J. Christopher Ball

(57) ABSTRACT

A cell to process a substrate includes at least one chamber wall, a membrane frame, and a membrane. The at least one chamber wall is arranged to form a cavity below a holder of the substrate. The membrane frame is disposed on the at least one chamber wall and across the cavity. The membrane is supported by the membrane frame and separating a first electrolyte from a second electrolyte. The membrane includes a surface extending from a center of the cavity radially outward at an angle relative to a reference plane, and wherein the angle is greater than or equal to 0° and less than or equal to 3°.

20 Claims, 5 Drawing Sheets

(56) References Cited

U.S. PATENT DOCUMENTS

| | | | |
|---|---|---|---|
| 8,262,871 | B1 | 9/2012 | Mayer et al. |
| 8,603,305 | B2 | 12/2013 | Rash et al. |
| 9,139,927 | B2 | 9/2015 | Rash et al. |
| 9,523,155 | B2 | 12/2016 | Mayer et al. |
| 9,534,308 | B2 | 1/2017 | Chua et al. |
| 9,624,592 | B2 | 4/2017 | Abraham et al. |
| 9,834,852 | B2 | 12/2017 | Mayer et al. |
| 10,094,034 | B2 | 10/2018 | Graham et al. |
| 10,106,907 | B2 | 10/2018 | Chua et al. |
| 10,190,230 | B2 | 1/2019 | Abraham et al. |
| 10,364,505 | B2 | 7/2019 | Thorkelsson et al. |
| 10,662,545 | B2 | 5/2020 | Mayer et al. |
| 10,954,605 | B2 | 3/2021 | Chua et al. |
| 11,001,934 | B2 | 5/2021 | Banik, II et al. |
| 11,047,059 | B2 | 6/2021 | Thorkelsson et al. |
| 2005/0092601 | A1 | 5/2005 | Herchen |
| 2016/0222535 | A1* | 8/2016 | Zhou ..... C25D 5/04 |
| 2016/0265132 | A1* | 9/2016 | Graham ..... C25D 21/12 |
| 2019/0055665 | A1 | 2/2019 | Banik, II et al. |
| 2019/0085479 | A1 | 3/2019 | Banik, II et al. |

FOREIGN PATENT DOCUMENTS

| | | | |
|---|---|---|---|
| CN | 108707940 | A | 10/2018 |
| KR | 1020080102266 | A | 11/2008 |
| WO | WO-2019041154 | A1 | 3/2019 |

OTHER PUBLICATIONS

International Search Report and Written Opinion of the ISA issued in PCT/US2020/048972, mailed Dec. 18, 2020; ISA/KR.

Allowance issued in corresponding Chinese Patent Application 202080062180X dated Aug. 21, 2024.

* cited by examiner

LOW ANGLE MEMBRANE FRAME FOR AN ELECTROPLATING CELL

CROSS-REFERENCE TO RELATED APPLICATIONS

This application is a U.S. National Phase Application under 35 U.S.C. 371 of International Application No. PCT/US2020/048972, filed on Sep. 2, 2020, which claims the benefit of U.S. Provisional Application No. 62/895,245, filed on Sep. 3, 2019. The entire disclosures of the applications referenced above are incorporated herein by reference.

FIELD

The present disclosure relates to electroplating apparatus and more particularly to a membrane frame for an electroplating apparatus.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Electroplating may be used to form current carrying lines during processing of semiconductors and/or packaging and multi-chip interconnection. Examples of applications include wafer level processing (WLP) and through silicon via (TSV).

During extended high current electroplating, plating chemical conductivity varies. As a result, plating thickness may vary from center to edge. In other words, plating at the center of the substrate may be thicker than at the edge of the substrate. To reduce the effects of chemical conductivity changes, the anolyte in the anode chamber is periodically chemically refreshed, which increases the cost of the process.

SUMMARY

A cell to process a substrate is provided. The cell includes at least one chamber wall, a membrane frame, and a membrane. The at least one chamber wall is arranged to form a cavity below a holder of the substrate. The membrane frame is disposed on the at least one chamber wall and across the cavity. The membrane is supported by the membrane frame and separating a first electrolyte from a second electrolyte. The membrane includes a surface extending from a center of the cavity radially outward at an angle relative to a reference plane, and wherein the angle is greater than or equal to 0° and less than or equal to 3°.

In other features, the cell further includes a high resistance virtual anode plate disposed above the membrane frame. The reference plane extends parallel to a surface of the high resistance virtual anode plate. In other features, the surface of the high resistance virtual anode plate is a top surface or a bottom surface of the high resistance virtual anode plate.

In other features, the reference plane extends in a horizontal direction. In other features, the reference plane extends parallel to a surface of the substrate while the substrate is processed in the cell. In other features, the reference plane extends parallel to a surface of a bottom wall of the cell. The at least one chamber wall includes the bottom wall.

In other features, a portion of the membrane frame at which the membrane is attached is V'-shaped. In other features, the membrane is V'-shaped when supported by the membrane frame. In other features, at least a portion of the membrane is ion permeable.

In other features, the surface is a first surface. The membrane frame includes a second surface. The first surface and the second surface slope inwardly and downwardly at the angle towards a centerline of the cavity.

In other features, the angle is less than or equal to 2°. In other features, the angle is less than or equal to 1°. In other features, the angle is between 1-2°. In other features, the angle is between 2-3°.

In other features, the membrane is an ion permeable membrane separating a first electrolyte disposed on a first side of the membrane from a second electrolyte disposed on a second side of the membrane.

In other features, the membrane frame includes clamps for holding the membrane. In other features, the membrane frame includes a vent for releasing gas from within the cavity. In other features, the cell further includes an electrode disposed in the cavity below the membrane. In other features, the electrode is an anode.

In other features, the cell further includes a high resistance virtual anode plate, a top side insert, a cup, and a cone. The high resistance virtual anode plate is disposed above the membrane frame. The top side insert is disposed above the high resistance virtual anode plate. The cup is disposed above the top side insert. The cone is disposed above the cup. The cup and cone are configured to hold the substrate.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A membrane frame for an electroplating cell according to the present disclosure compensates for variations in chemical conductivity of the anolyte during extended high current plating. For example, high current copper plating causes the conductivity of the anolyte in the anode chamber to decrease over time. The change in conductivity causes variations in the wafer plating profile. In other words, the plating thickness at the center of the substrate increases (relative to plating at the radially outer portion of the substrate) as the conductivity decreases.

Previous approaches for reducing the center to edge thickness variations include idling the electroplating cell to allow acid back diffusion to correct anode chamber conductivity. However, this approach is too slow for high volume manufacturing using high current plating. Another approach involves chemically refreshing the anolyte in the anode chamber to increase conductivity. This approach is cost prohibitive to the end user.

The membrane frame according to the present disclosure compensates for variations in plating chemical conductivity during extended high current plating. More particularly, surfaces of the membrane frame extend inwardly and downwardly at a predetermined downward angle (greater than 0.5° and less than or equal to 3°, 2° or 1°) relative to horizontal. The predetermined downward angle of the membrane frame helps to provide uniform anode chamber resistance from substrate center to edge as chemical conductivity changes during extended high current plating. The shallow angle of the membrane frame is able to remove trapped air during initial filling of the anode chamber and over the duration of operation.

Figure 1:
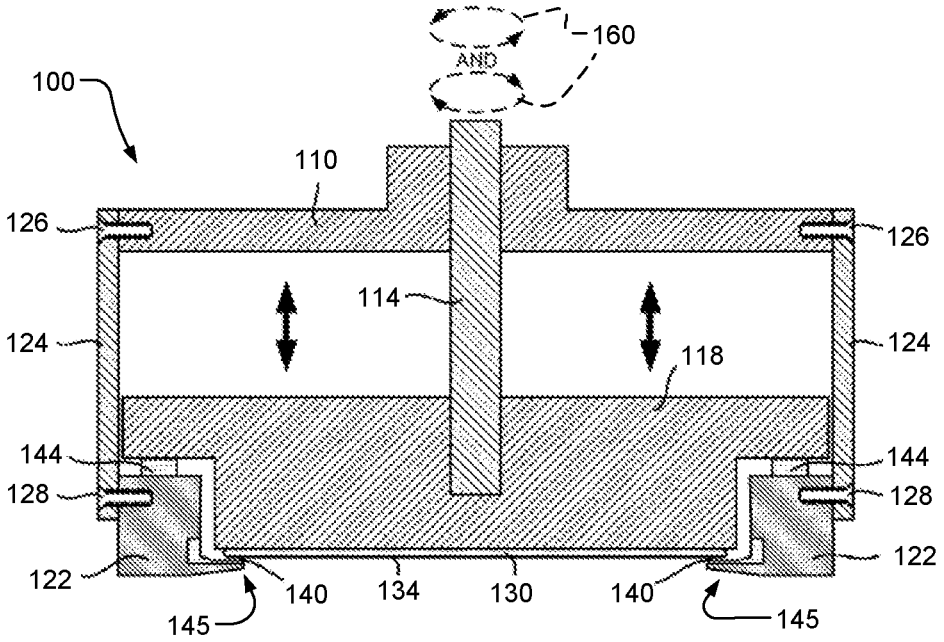
FIG. 1 is a side cross-sectional view of an example of a substrate holder according to the present disclosure.

Referring now to FIG. 1, a substrate holder 100 is shown to include an upper plate 110, a spindle 114 selectively raised, lowered, and/or rotated by one or more motors (not shown), a cone 118 and a cup 122. An upper end of a cylindrical strut 124 is connected by fasteners 126 to the upper plate 110. A lower end of the cylindrical strut 124 is connected by fasteners 128 to the cup 122. A seal 144 may be arranged between a lower surface of the cone 118 and an upper surface of the cup 122. Likewise, a seal 140 may be arranged between a substrate 130 and a radially inwardly projecting portion 145 of the cup 122.

When loading the substrate 130, the cone 118 is moved upwardly towards the plate 110 and the cup 122 remains stationary. A robot (not shown) loads the substrate 130 between a lower portion of the cone 118 and the radially inwardly projecting portion 145 of the cup 122. The cone 118 is lowered against the seals 140 and 144. As a result, a seal is formed between a radially outer edge of a downwardly facing surface of the substrate 130 and the radially inwardly projecting portion of the cup 122. Likewise, the seal 144 prevents electrolyte from reaching a back side surface of the substrate 130.

Figure 2:
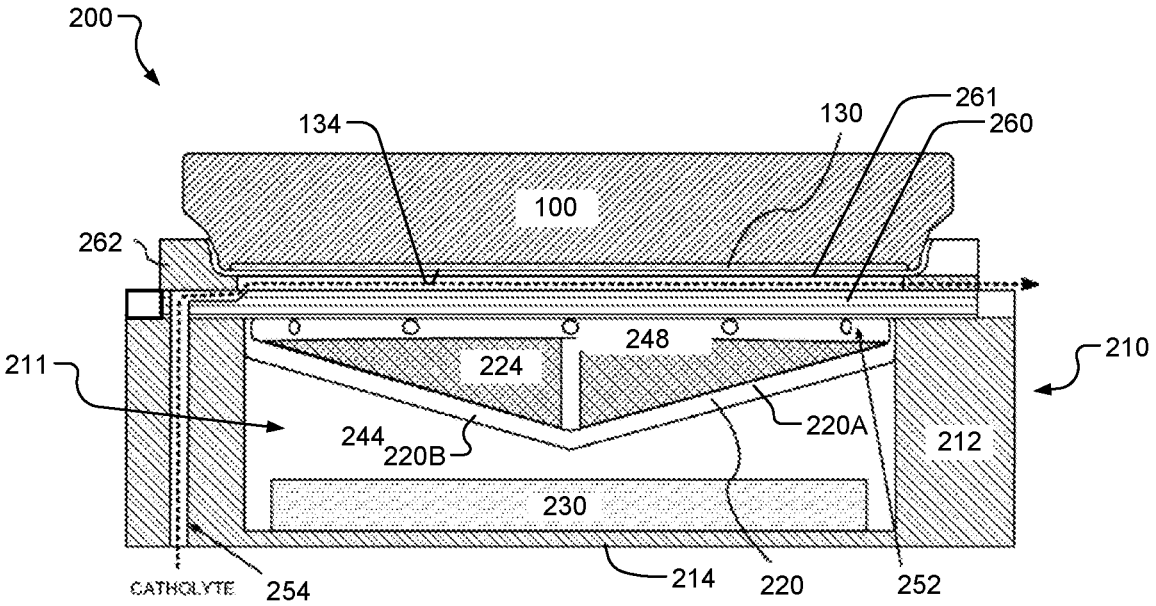
FIG. 2 is a side cross-sectional view of an example of an electroplating system including the substrate holder and an electroplating cell according to the present disclosure.

Referring now to FIG. 2, an electroplating system 200 is shown to include the substrate holder 100 and an electroplating cell 210. The electroplating cell 210 includes a chamber (or cavity) 211 defined at least partially by chamber walls 212 and a bottom chamber wall 214. The electroplating cell 210 further includes a membrane frame 220 having portions 220A and 220B and supporting a membrane 224 located in the chamber 211. In some examples, the membrane 224 includes an ion permeable membrane. An electrode 230 such as a copper anode is arranged in a lower portion 244 of the chamber 211.

The upper portion 248 and the lower portion 244 of the chamber 211 are separated by the membrane 224. A first electrolyte, such as an anolyte is located in the lower portion 244 of the chamber 211 and a second electrolyte, such as a catholyte is located in the upper portion 248 of the chamber 211. As an example, a catholyte may be supplied through inlets 252, into the upper portion 248 of the chamber 211, through vertical holes (not shown) in a plate 260 and into a manifold 261 where the substrate 130 is located. The plate 260 may be implemented as a high resistance virtual anode (HRVA) plate. In other words, the catholyte impinges on the substrate in a transverse direction relative to a plane. A bottom surface 134 of the substrate 130 may be coplanar with and/or parallel to the plane. Catholyte may also be supplied in a direction parallel to the plane and the bottom surface 134 through channel 254 (as shown by dotted lines).

The plate 260 is disposed on the chamber walls 212. A top side insert 262 is disposed on the plate 260 and may include a flow ring (not shown) in FIG. 2. The substrate holder 100 is disposed above and moved vertically relative the top side insert 262. During use, the substrate holder 100 is lowered to expose the bottom surface 134 of the substrate 130 to the electrolyte in the upper portion 248 of the chamber 211. As an example, the substrate 130 may be exposed to a catholyte and the bottom surface 134 may be plated. Catholyte may be supplied across the substrate 130 in two directions as described above. The spindle 114 may be used to rotate the substrate holder 100 and the substrate 130 in one or both directions indicated by dashed lines 160 of FIG. 1. The membrane 224 may be an ion permeable membrane that allows ions to pass but otherwise separates an anolyte and a catholyte in the chamber 211.

Additional details relating to membranes, electroplating cells and/or substrate holders can be found in commonly-assigned U.S. Patent Publication 2014/0183049, which is hereby incorporated by reference in its entirety.

Figure 3:
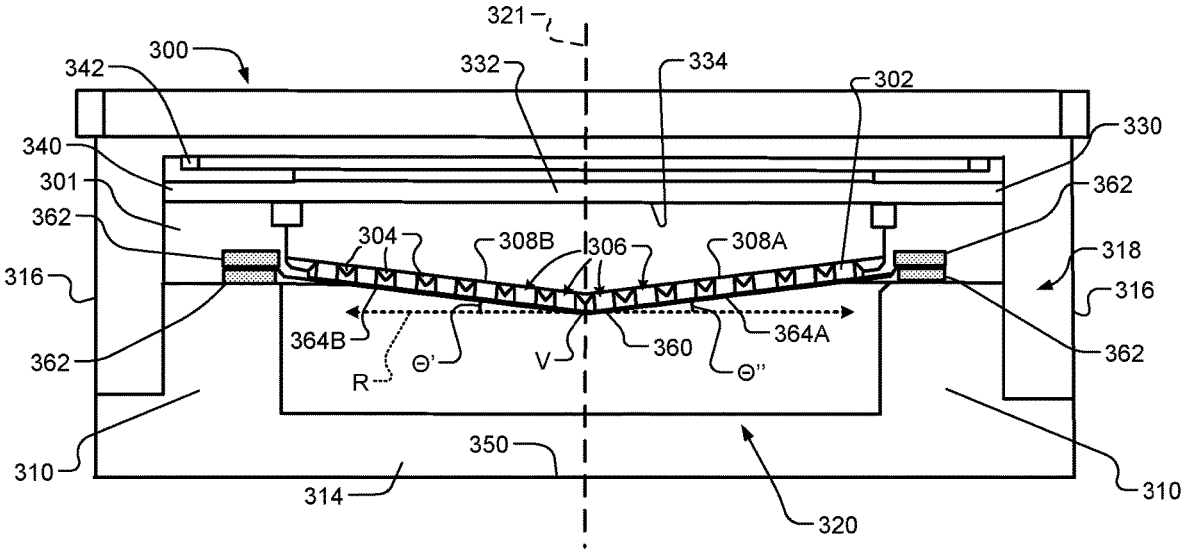
FIG. 3 is a side cross-sectional view of an example of a high angle membrane frame for an electroplating cell.

FIG. 3 shows a cell 300 including a membrane frame 301 including a grid 302 having cross members 304 and an array of holes 306. The membrane frame 301 may replace the membrane frame 220 of FIG. 2. The membrane frame 301 is disposed on chamber walls 310 of the cell 300. The cell 300 may be an electroplating cell including an anode chamber including the chamber walls 310 and a bottom chamber wall 314. The cell 300 includes an outer weir (or cell walls) 316 that provide a first cavity 318. The chamber walls 310 are disposed in the first cavity 318 and form at least a portion of a second cavity 320. The membrane frame 301 and the chamber walls 310 define at least a portion of the second cavity 320.

A plate 330 (e.g., a HRVA plate) is disposed on the membrane frame 301 and includes a top surface 332 and a bottom surface 334. A top side insert 340 is disposed on the plate 330 and may include a flow ring 342. A substrate holder similar to the substrate holder 100 of FIG. 1 may be moved vertically relative to the plate 330.

The grid 302 has a "V"-shaped cross-sectional profile with opposing members 308A, 308B at high angles relative to a reference plane R. Although the reference plane R is shown intersecting a vertex (or bottom point) V of the membrane frame 301, the reference plane R may be coplanar with and/or extend parallel to a surface of a substrate (e.g., the bottom surface 134 of FIG. 1), a surface of a plate (e.g., one or both of the surfaces 332, 334), a surface of the bottom chamber wall 314, such as the top surface 350. In one embodiment, the reference plane R extends horizontally.

A membrane 360 is supported on a bottom of the membrane frame 301. The membrane extends laterally across the membrane frame 301 and is held by clamps 362 of the membrane frame 301. The membrane 360 has a center at the vertex V from which a conical surface 364 (illustrated by portions 364A and 364B) extends radially outwards and upwards. The shown cross-section illustrates angles of the opposing portions 364A, 364B of the conical surface 364. In an embodiment, the angles are the same. The angles are low angles as further described below. The angles ⊖', ⊖" of the membrane 360 may be the same as the angles of the members 308A, 308B. The angles ⊖', ⊖" may be the same or different.

The members 308A, 308B and the conical surface 364 slope inwardly and downwardly relative to the reference plane R from a radially outer edge of the second cavity 320 at one or more predetermined angles. The conical surface 364 may slope downwardly to a point at the vertex V, which may be along a centerline 321 and/or in a middle of the second cavity 320 and/or corresponding chamber. The centerline 321 may extend through a center of the cell 300, the membrane frame 301 and/or the plate 330.

In certain applications, gas bubbles are produced during electroplating. For example, plating of tin/sliver (SnAg) inert anode systems produce gas bubbles during plating. After testing, it was determined that setting the one or more predetermined angles of the members 308A, 308B and the conical surface 364 to values that are greater than or equal to 7° ensured gas bubble clearance for a wide variety of chemistries. Using this angled arrangement, however, causes variations in plating thickness from center to edge as the conductivity changes.

Figure 4A:
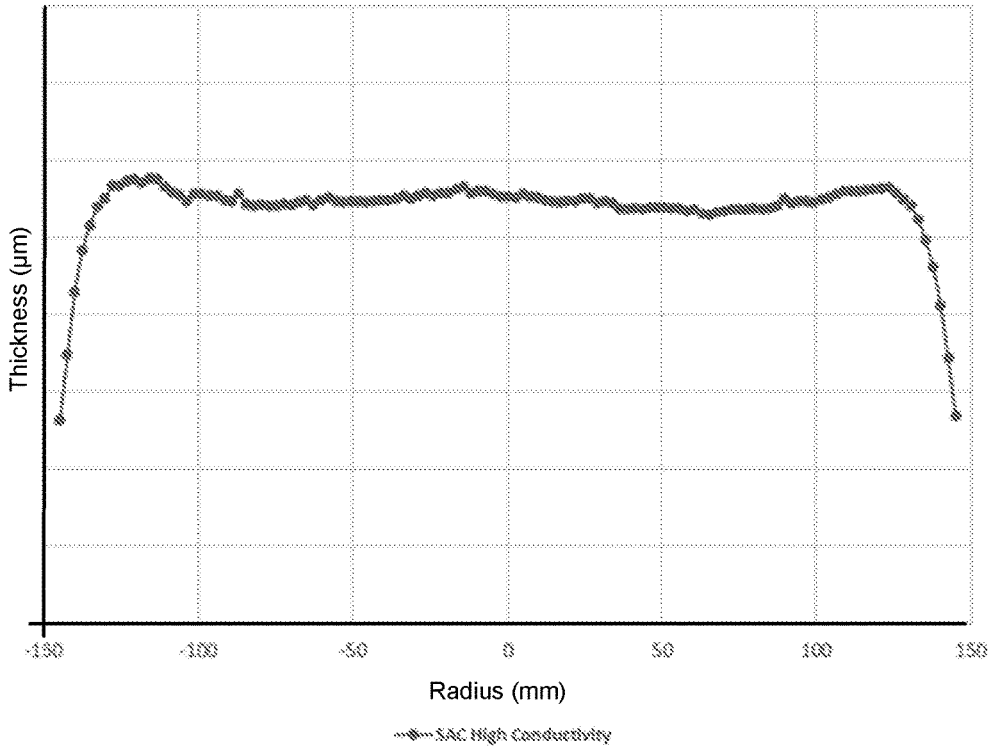
FIGS. 4A and 4B are graphs showing plating thicknesses after an anolyte is initially used and after extended high current plating.
Figure 4B:
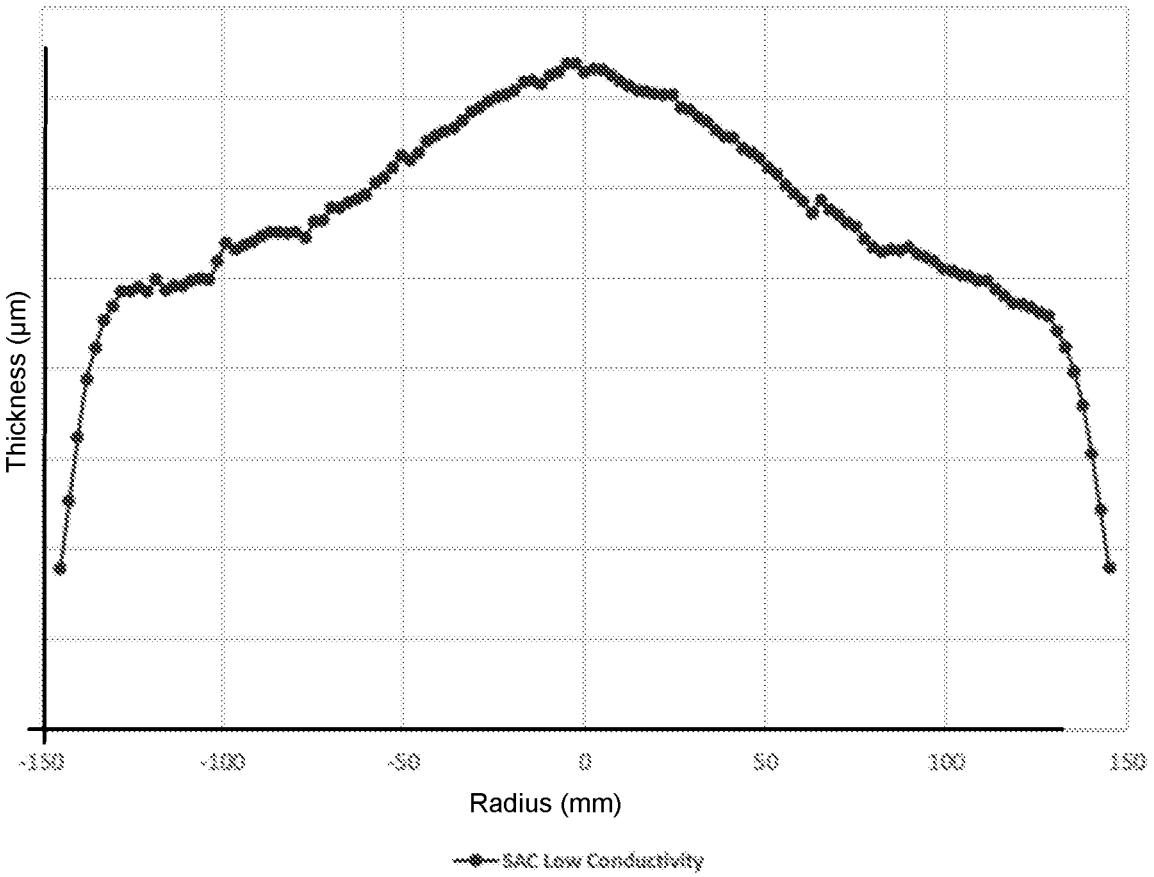

Referring now to FIGS. 4A and 4B, during extended high current plating, plating chemical conductivity varies. In FIG. 4A, plating thickness is relatively uniform across the radius of the substrate. As plating progresses, the plating chemical conductivity varies. In FIG. 4B, plating thickness is higher in the center of the substrate and lower at edges of the substrate when using the arrangement in FIG. 3.

Figure 5:
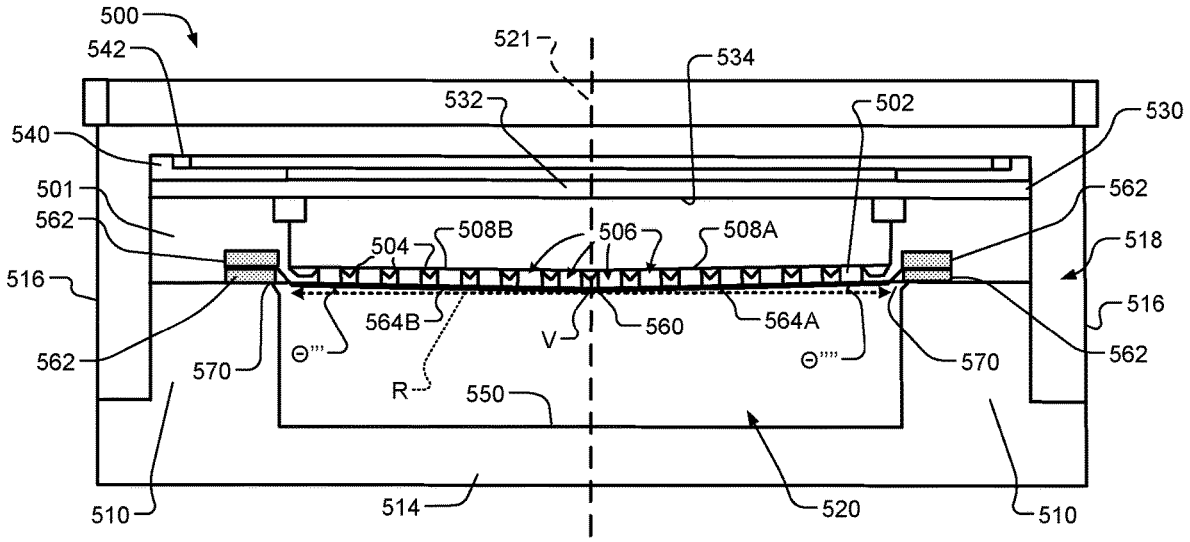
FIG. 5 is a side cross-sectional view of an example of a low angle membrane frame for an electroplating cell according to the present disclosure.

FIG. 5 shows a cell 500 including a membrane frame 501 including a grid 502 having cross members 504 and an array of holes 506. The membrane frame 501 may replace the membrane frame 220 of FIG. 2. The membrane frame 501 is disposed on chamber walls 510 of the cell 500. The cell 500 may be an electroplating cell including an anode chamber including the chamber walls 510 and a bottom chamber wall 514. The cell 500 includes cell walls 516 that provide a first cavity 518. The chamber walls 510 are disposed in the first cavity 518 and form at least a portion of a second cavity 520. The membrane frame 501 and the chamber walls 510 define at least a portion of the second cavity 520.

A plate 530 (e.g., a HRVA plate) is disposed on the membrane frame 501 and includes a top surface 532 and a bottom surface 534. A top side insert 540 is disposed on the plate 530 and may include a flow ring 542. A substrate holder similar to the substrate holder 100 of FIG. 1 may be moved vertically relative to the plate 530.

The grid 502 has a "V"-shaped cross-sectional profile with opposing members 508A, 508B at low angles relative to a reference plane R. Although the reference plane R is shown intersecting a vertex (or bottom point) V of the membrane frame 501, the reference plane R may be coplanar with and/or extend parallel to a surface of a substrate (e.g., the bottom surface 134 of FIG. 1), a surface of a plate (e.g., one or both of the surfaces 532, 534), a surface of the bottom chamber wall 514, such as the top surface 550. In one embodiment, the reference plane R extends horizontally.

A membrane 560 is supported on a bottom of the membrane frame 501. The membrane extends laterally across the membrane frame 501 and is held by clamps 562 of the membrane frame 501. The membrane 560 has a center at the vertex V from which a conical surface 564 (illustrated by portions 564A and 564B) extends radially outwards and upwards. The shown cross-section illustrates angles of the opposing portions 564A, 564B of the conical surface 564. In an embodiment, the angles are the same. The angles are low angles as further described below. The angles ⊖''', ⊖'''' of the membrane 560 may be the same as the angles of the members 508A, 508B. The angles ⊖''', ⊖'''' may be the same or different.

The members 508A, 508B and the conical surface 564 slope inwardly and downwardly relative to the reference plane R from a radially outer edge of the second cavity 520 at one or more predetermined angles. The conical surface 564 may slope downwardly to a point at the vertex V, which may be along a centerline 521 and/or in a middle of the second cavity 520 and/or corresponding chamber. The centerline 521 may extend through a center of the cell 500, the membrane frame 501 and/or the plate 530.

The one or more angles of the membrane 520, such as the angles ⊖''', ⊖'''' may be set to a value that is greater than 0° and less than or equal to 1-3°. In one embodiment, the angles are between 0°-3°. In another embodiment, the angles are between 0°-2°, In yet another embodiment, the angles are between 0°-1°. In another embodiment, the angles are set equal to at least one of 3°, 2°, or 1°. In another embodiment, the angles are all set equal to one of 3°, 2°, or 1°. For example only, the angles may be set to 1°-3° as shown in FIG. 5. In another embodiment, the angles are set between 1°-2° or 2°-3°. In another embodiment, the angles may be set to 0.5°-1°. In one embodiment, one or more of the angles of the membrane 520, such as the angles ⊖''', ⊖'''', are set equal to 0°.

The membrane frame 501 as described herein allows uniform anode chamber resistance from center to edge as chemical conductivity changes during extended high current plating. This is because the conical surface 564 of the membrane 560 extends center-to-outer edge at small angles, such that the conical surface 564 is close to being planar and close to extending in a horizontal direction. In other words, the conical surface 564 is slightly conical. The smaller the angles and thus the more planar and/or horizontal extending the conical surface 564, the more uniform the anode chamber resistance laterally across the anode chamber from center to radially outermost edge.

The angles of the membrane 560 as described herein also allow for trapped air removal during initial filling of the second cavity and over the duration of operation. The chamber defined by the membrane frame 301 and the chamber walls 510 includes one or more vents (vents 570 are shown) to allow for gas to escape. Since the bottom surface (or surfaces) of the membrane 560 are at a slight angle, gas is able to move upward and outward towards the vents and be removed from the second cavity 520.

Figure 6A:
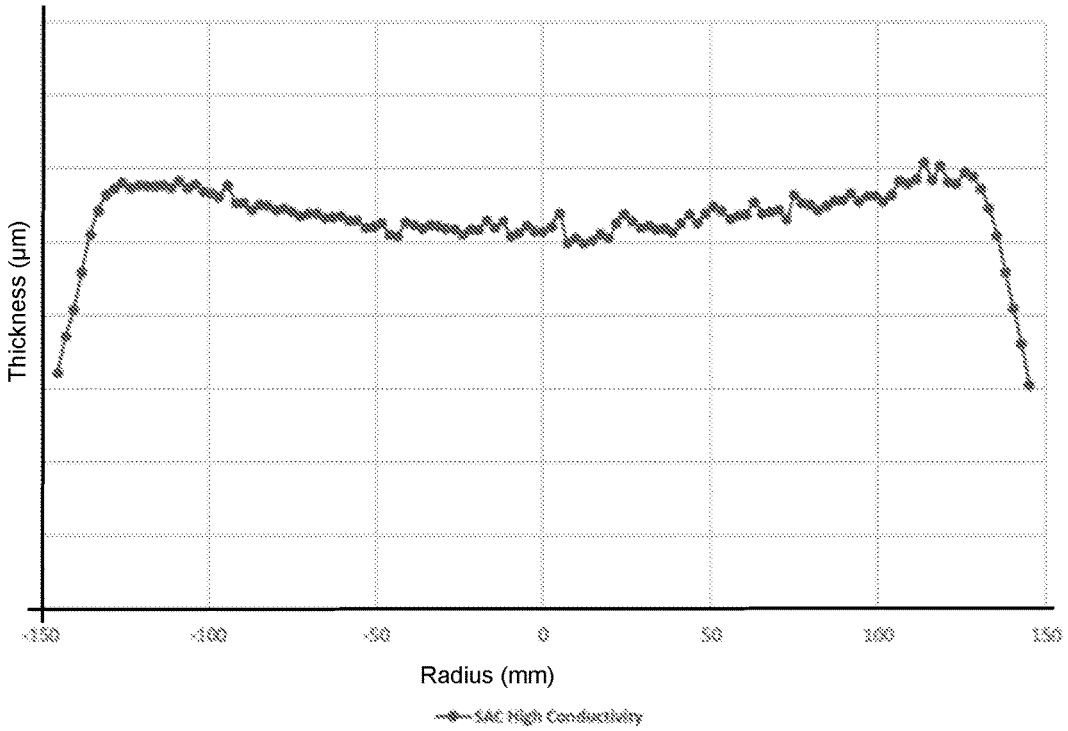
FIGS. 6A and 6B are graphs showing plating thicknesses after the anolyte is initially used and after extended high current plating.
Figure 6B:
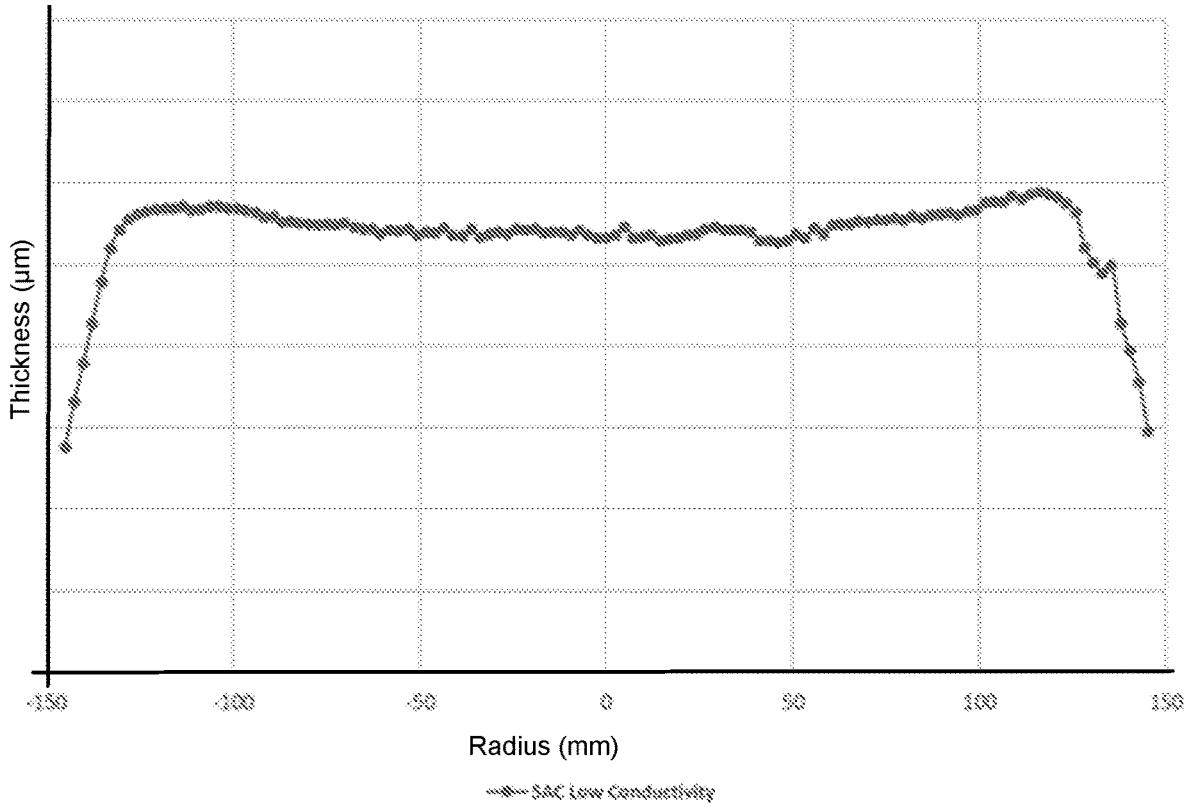

Referring now to FIGS. 6A and 6B, during extended high current plating, plating chemical conductivity varies. In FIG. 6A, plating thickness is relatively uniform across the radius of the substrate at the beginning of plating with the electrolyte. After plating has progressed, the plating chemical conductivity varies. However, using the membrane frame 501 and membrane 560 as described herein reduces plating thickness variation. In FIG. 6B, plating thickness is relatively uniform across the radius of the substrate after plating has progressed.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. A cell to process a substrate, the cell comprising:

at least one chamber wall arranged to form a cavity below a holder of the substrate;

a membrane frame disposed on the at least one chamber wall and across the cavity; and a membrane supported by the membrane frame and separating a first electrolyte from a second electrolyte, wherein the membrane comprises a surface extending from a center of the cavity radially outward and upward at an angle relative to a reference plane, wherein the angle is above the reference plane and measured from the reference plane to the surface of the membrane, and wherein the angle is greater than or equal to 0° and less than or equal to 3°.

2. The cell of claim 1, further comprising a high resistance virtual anode plate disposed above the membrane frame, wherein the reference plane extends parallel to a surface of the high resistance virtual anode plate.

3. The cell of claim 2, wherein the surface of the high resistance virtual anode plate is a top surface or a bottom surface of the high resistance virtual anode plate.

4. The cell of claim 1, wherein the reference plane extends in a horizontal direction.

5. The cell of claim 1, wherein the reference plane extends parallel to a surface of the substrate while the substrate is processed in the cell.

6. The cell of claim 1, wherein the reference plane extends parallel to a surface of a bottom wall of the cell, wherein the at least one chamber wall includes the bottom wall.

7. The cell of claim 1, wherein a portion of the membrane frame at which the membrane is attached is 'V'-shaped.

8. The cell of claim 1, wherein the membrane is 'V'-shaped when supported by the membrane frame.

9. The cell of claim 1, wherein at least a portion of the membrane is ion permeable.

10. The cell of claim 1, wherein:

the surface is a first surface;

the membrane frame comprises a second surface; and the first surface and the second surface slope inwardly and downwardly at the angle towards a centerline of the cavity.

11. The cell of claim 1, wherein the angle is less than or equal to 2°.

12. The cell of claim 1, wherein the angle is less than or equal to 1°.

13. The cell of claim 1, wherein the angle is between 1-2°.

14. The cell of claim 1, wherein the angle is between 2-3°.

15. The cell of claim 1, wherein the membrane is an ion permeable membrane separating the first electrolyte disposed on a first side of the membrane from the second electrolyte disposed on a second side of the membrane.

16. The cell of claim 1, wherein the membrane frame comprises clamps for holding the membrane.

17. The cell of claim 1, wherein the membrane frame comprises a vent for releasing gas from within the cavity.

18. The cell of claim 1, further comprising an electrode disposed in the cavity below the membrane.

19. The cell of claim 18, wherein the electrode is an anode.

20. The cell of claim 1, further comprising:

a high resistance virtual anode plate disposed above the membrane frame;

a top side insert disposed above the high resistance virtual anode plate;

a cup disposed above the top side insert; and a cone disposed above the cup, wherein the cup and cone are configured to hold the substrate.

* * * * *